US009484122B2

(12) United States Patent
Siewert et al.

(10) Patent No.: US 9,484,122 B2
(45) Date of Patent: Nov. 1, 2016

(54) POST-ACCIDENT FISSION PRODUCT REMOVAL SYSTEM AND METHOD OF REMOVING POST-ACCIDENT FISSION PRODUCT

(75) Inventors: Mark W. Siewert, Wilmington, NC (US); Phillip G. Ellison, Wilmington, NC (US); John R. Bass, Wilmington, NC (US)

(73) Assignee: GE-HITACHI NUCLEAR ENERGY AMERICAS LLC, Wilmington, NC (US)

( * ) Notice: Subject to any disclaimer, the term of this patent is extended or adjusted under 35 U.S.C. 154(b) by 956 days.

(21) Appl. No.: 13/340,943

(22) Filed: Dec. 30, 2011

(65) Prior Publication Data

US 2013/0170600 A1 Jul. 4, 2013

(51) Int. Cl.

| | |
|---|---|
| ***G21C 19/42*** | (2006.01) |
| ***G21F 9/00*** | (2006.01) |
| ***G21F 9/02*** | (2006.01) |

(52) U.S. Cl.

CPC ..... *G21F 9/001* (2013.01); *G21F 9/02* (2013.01)

(58) Field of Classification Search

CPC ..... G21F 9/02; G21K 1/10; G21K 1/12; G21K 1/14; G21K 1/16

USPC ..... 376/308–315

See application file for complete search history.

(56) References Cited

U.S. PATENT DOCUMENTS

| | | | | |
|---|---|---|---|---|
| 4,264,341 | A | 4/1981 | Kaufmann et al. | |
| 4,309,080 | A | 1/1982 | Hanchard et al. | |
| 4,559,067 | A | 12/1985 | Durston | |
| 4,572,710 | A | 2/1986 | Stock et al. | |
| 4,741,882 | A * | 5/1988 | Weichselgartner | G21F 9/02 376/146 |
| 4,820,426 | A | 4/1989 | Pfertzel et al. | |
| 4,895,666 | A | 1/1990 | Franzen et al. | |
| 4,897,221 | A * | 1/1990 | Manchak, Jr. | G21F 9/008 250/506.1 |
| 6,980,871 | B1 | 12/2005 | Sweat | |
| 2002/0057755 | A1 * | 5/2002 | Hemmi | G21C 19/307 376/313 |
| 2009/0151309 | A1 * | 6/2009 | Austin, Jr. | A62B 11/00 55/383 |
| 2010/0072059 | A1 * | 3/2010 | Peters | G21F 9/002 204/227 |

FOREIGN PATENT DOCUMENTS

| | | |
|---|---|---|
| CN | 201122444 Y | 9/2008 |
| JP | 61107932 A | 5/1986 |
| JP | 61148395 A | 7/1986 |
| JP | 62214398 A | 9/1987 |

(Continued)

OTHER PUBLICATIONS

Unofficial English Translation of Japanese Office Action issued in connection with corresponding JP Application No. 2012-278793 on Nov. 4, 2014.

(Continued)

*Primary Examiner* — Marshall O'Connor

(74) *Attorney, Agent, or Firm* — Harness, Dickey & Pierce, P.L.C.

(57) ABSTRACT

A post-accident fission product removal system may include an air mover, a filter assembly, and/or an ionization chamber. The air mover may be configured to move contaminated air through the filter assembly to produce filtered air. The ionization chamber may be connected to the filter assembly. The ionization chamber may include an anode and a cathode. The ionization chamber may be configured to receive the filtered air from the filter assembly and to ionize and capture radioisotopes from the filtered air to produce clean air.

21 Claims, 4 Drawing Sheets

(56) References Cited

FOREIGN PATENT DOCUMENTS

| | | | |
|---|---|---|---|
| JP | 62294410 | A | 12/1987 |
| JP | 6312998 | A | 1/1988 |
| JP | 05126993 | A | 5/1993 |
| JP | 07325192 | A | 12/1995 |
| TW | 200606957 | A | 12/2006 |

OTHER PUBLICATIONS

Search Report dated May 31, 2016, issued in corresponding TW Application No. 101147936.

* cited by examiner

POST-ACCIDENT FISSION PRODUCT REMOVAL SYSTEM AND METHOD OF REMOVING POST-ACCIDENT FISSION PRODUCT

BACKGROUND

1. Field

The present disclosure relates to a radioactive product removal system and a method of removing a radioactive product.

2. Description of Related Art

Hydrogen may be produced by damaged nuclear fuel after a nuclear reactor accident. The produced hydrogen poses a potential combustion and explosion hazard. For instance, reactor primary containment and associated rooms could accumulate the produced hydrogen and experience an explosion. To decrease the risk of an explosion, the containment hydrogen concentration could be reduced by venting. Venting may also be used as a safety measure in other situations. However, harmful fission products may be released to the environment by the venting.

SUMMARY

A post-accident fission product removal system may include an air mover connected to a filter assembly. The air mover may be configured to move contaminated air through the filter assembly to produce filtered air. An ionization chamber may be connected to the filter assembly. The ionization chamber may include an anode and a cathode. The ionization chamber may be configured to receive the filtered air from the filter assembly and to ionize and capture radioisotopes from the filtered air to produce clean air.

A method of removing a post-accident fission product may include filtering contaminated air containing radioisotopes to produce filtered air. The filtered air may be ionized to facilitate the electrostatic capture of the radioisotopes to produce clean air.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
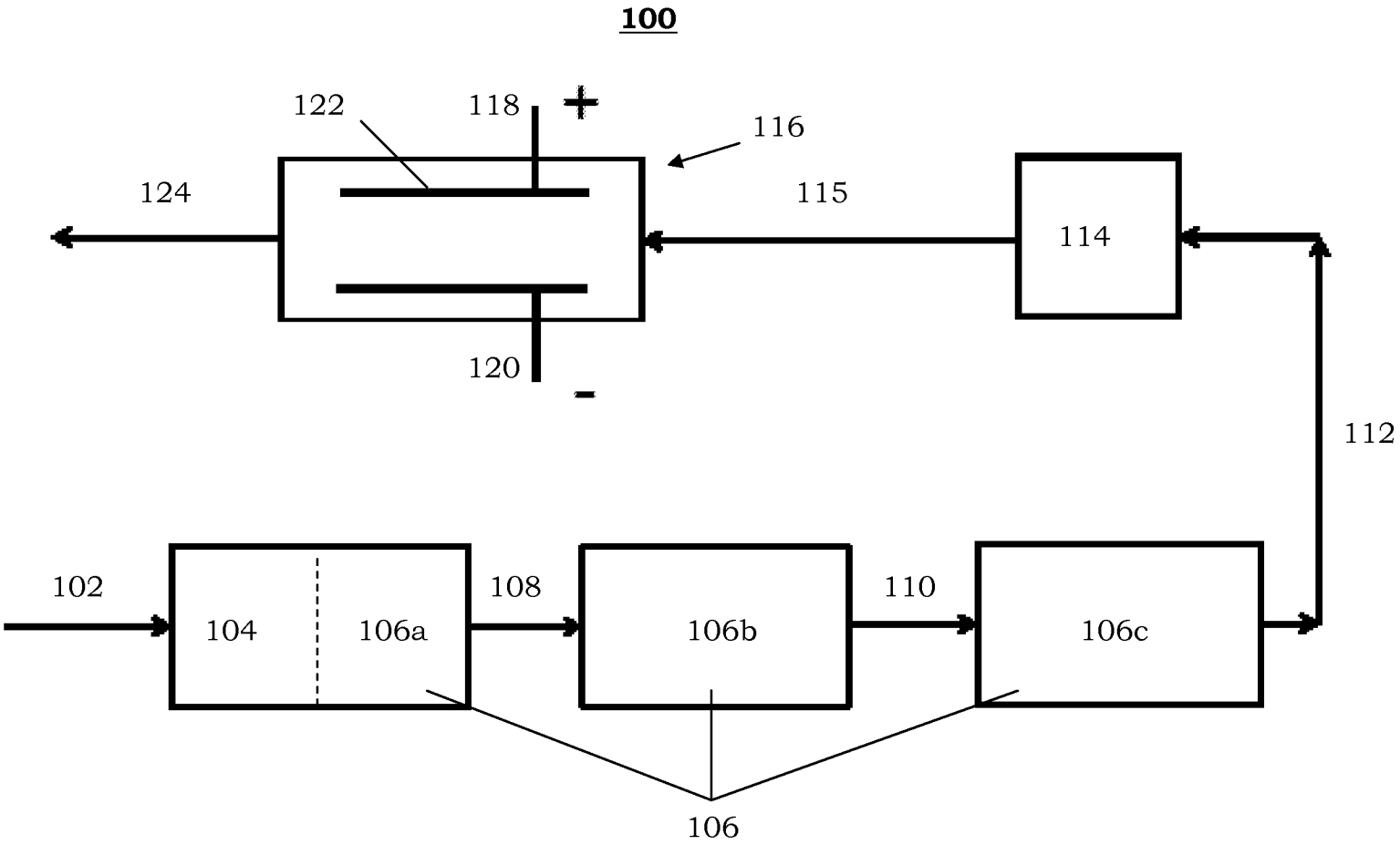
FIG. 1 is a schematic view of a post-accident fission product removal system according to a non-limiting embodiment of the present invention.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and/or intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a schematic view of a post-accident fission product removal system according to a non-limiting embodiment of the present invention. Referring to FIG. 1, a post-accident fission product removal system 100 includes an air mover 104 connected to a filter assembly 106. The air mover 104 may be configured to move contaminated air 102 through the filter assembly 106 to produce filtered air 115. The air mover 104 may be a blower or a vacuum, although example embodiments are not limited thereto.

The filter assembly 106 may include a centrifugal separator 106*a*, a charcoal filter 106*b*, and/or a high-efficiency particulate air (HEPA) filter 106*c*. Although the air mover 104 is shown in FIG. 1 as being integrated with the centrifugal separator 106*a*, it should be understood that the example embodiments are not limited thereto. For instance, the air mover 104 and the centrifugal separator 106*a* may be separate and independent pieces of equipment.

The centrifugal separator 106*a* may be configured to receive the contaminated air 102 and to initially separate out larger-sized debris from the contaminated air 102 so as to output centrifuged air 108. For example, the centrifugal separator 106*a* may separate entrained particle aerosols and/or debris from air. The charcoal filter 106*b* may be connected to the centrifugal separator 106*a*. The charcoal filter 106*b* may include activated carbon. The charcoal filter 106*b* may be configured to receive the centrifuged air 108 and to remove gases with an affinity to the activated carbon so as to output carbon-filtered air 110. The high-efficiency particulate air (HEPA) filter 106*c* may be connected to the charcoal filter 106*b*. The high-efficiency particulate air filter 106*c* may be configured to receive the carbon-filtered air 110 and to remove smaller particulates missed by the charcoal filter 106*b* so as to output HEPA-filtered air 112. For instance, the high-efficiency particulate air filter 106*c* may remove 99.97% of all particles greater than 0.3 micrometer from the air that passes through.

An ionization chamber 116 may be connected to the filter assembly 106. The ionization chamber 116 includes an anode 118 and a cathode 120. The anode 118 may be positively charged, while the cathode 120 may be negatively charged. The anode 118 and the cathode 120 may be in the form of charged plates 122 in the ionization chamber 116. For example, the anode 118 may be in the form of one charged plate 122, and the cathode 120 may be in the form of another charged plate 122. In such a case, there will be two charged plates 122 in the ionization chamber 116. In another non-limiting embodiment, each of the anode 118 and the cathode 120 may be in the form of at least two charged plates 122. In such a case, there will be at least four charged plates 122 in the ionization chamber 116. The at least two charged plates 122 of each of the anode 118 and cathode 120 may be alternately arranged with each other. The charged plates 122 may also be arranged in parallel. It should be understood that the various embodiments discussed herein are merely simplified examples for purposes of presentation. That being said, it should be understood that there may be numerous plate pairs depending upon the extent (size, diameter) of the ionization chamber.

The charged plates 122 may be in planar form. Alternatively, the charged plates 122 may be in curved form. For instance, when the ionization chamber 116 is in the form of a cylinder, the charged plates 122 may be curved so as to conform to the internal contours of the ionization chamber 116. The surface of the charged plates 122 may be smooth or patterned. For example, the surface of at least one of the charged plates 122 may have a chevron pattern.

The ionization chamber 116 may be configured to receive the filtered air 115 from the filter assembly 106 and to ionize and capture radioisotopes from the filtered air 115 to produce clean air 124. For instance, the ionization chamber 116 may be configured such that the filtered air 115 from the filter assembly 106 is directed to a flow path passing between the anode 118 and the cathode 120.

The ionization chamber 116 may also be configured to permit sealing and detachment from the post-accident fission product removal system 100 prior to excessive accumulation of the radioisotopes in the ionization chamber 116. The sealed ionization chamber 116 may be replaced with a new ionization chamber. The ionization chamber 116 may be a canister type container. The ionization chamber 116 may also have a battery power source configured to maintain a charge on the anode 118 and cathode 120 to prevent escape of the radioisotopes during the sealing and detachment of the ionization chamber 116. The captured radioisotopes in the sealed and detached ionization chamber 116 may be subjected to processing and/or prolonged confinement by the sealed ionization chamber 116 for a sufficient period of time while the radioisotopes decay (various radioisotopes have relatively short half-lives).

The post-accident fission product removal system 100 may further include a laser separator 114 connected between the filter assembly 106 and the ionization chamber 116. In such a case, the HEPA-filtered air 112 may be additionally treated by the laser separator 114 to obtain the filtered air 115. The laser separator 114 may be configured to separate radioisotopes in the HEPA-filtered air 112 based on mass. As a result, although radioisotopes will be present in the filtered air 115, the radioisotopes will be separated by mass because of the laser separator 114. For example, the trajectory of radioisotopes with a greater mass will be less affected by the momentum of a laser than radioisotopes with a smaller mass.

The radioisotopes to be removed by the post-accident fission product removal system 100 may originate from damaged or melted fuel and/or from contaminated combustion products resulting from fire, although the example embodiments are not limited thereto. The post-accident fission product removal system 100 may be designed as a portable system that can be used to ventilate and clean relatively small areas. For example, the portable system may be an elephant trunk type system. Alternatively, the post-accident fission product removal system 100 may be designed as an in-place equipment to ventilate and clean larger areas (e.g., dry well primary containment reactor building rooms).

Figure 2:
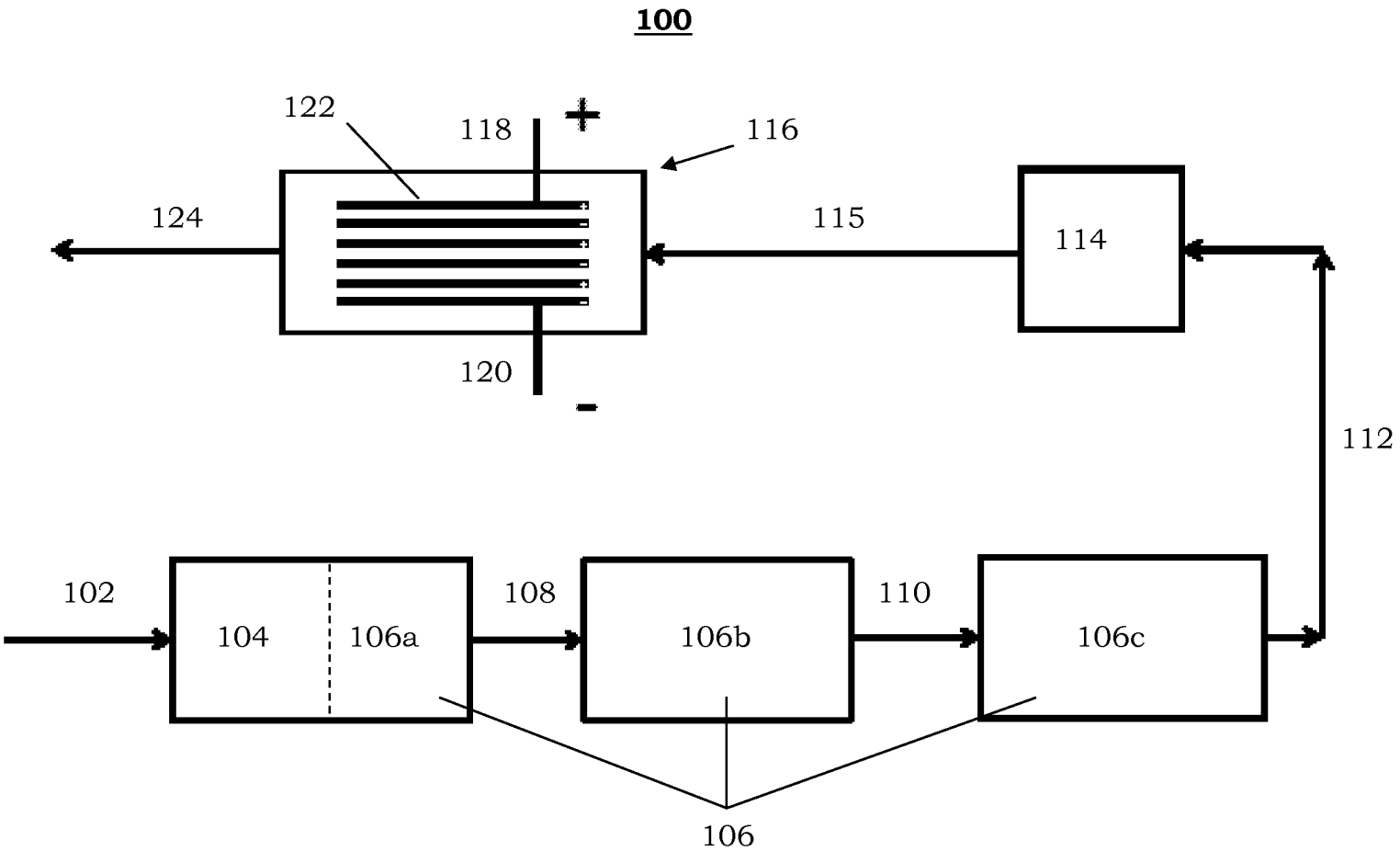
FIG. 2 is a schematic view of another post-accident fission product removal system according to a non-limiting embodiment of the present invention.

FIG. 2 is a schematic view of another post-accident fission product removal system according to a non-limiting embodiment of the present invention. Referring to FIG. 2, the post-accident fission product removal system 100 may be as described in connection with FIG. 1 except that each of the anode 118 and cathode 120 in the ionization chamber 116 may be in the form of three charged plates 122. Thus, six charged plates 122 may be present in the ionization chamber 116, wherein three charged plates 122 correspond to the anode 118 and three charged plates 122 correspond to the cathode 120. The three charged plates 122 corresponding to the anode 118 may be positively charged, while the three charged plates 122 corresponding to the cathode 120 may be negatively charged. The three charged plates 122 corresponding to the anode 118 may be alternately arranged with the three charged plates 122 corresponding to the cathode 120.

Although each of the anode 118 and cathode 120 in the ionization chamber 116 are shown in FIG. 2 as being in the form of three charged plates 122, it should be understood that the example embodiments are not limited thereto. For instance, each of the anode 118 and cathode 120 in the ionization chamber 116 may be in the form of two charged plates 122 (for a total of four charged plates 122) or four or more charged plates 122 (for a total of eight or more charged plates 122).

Figure 3:
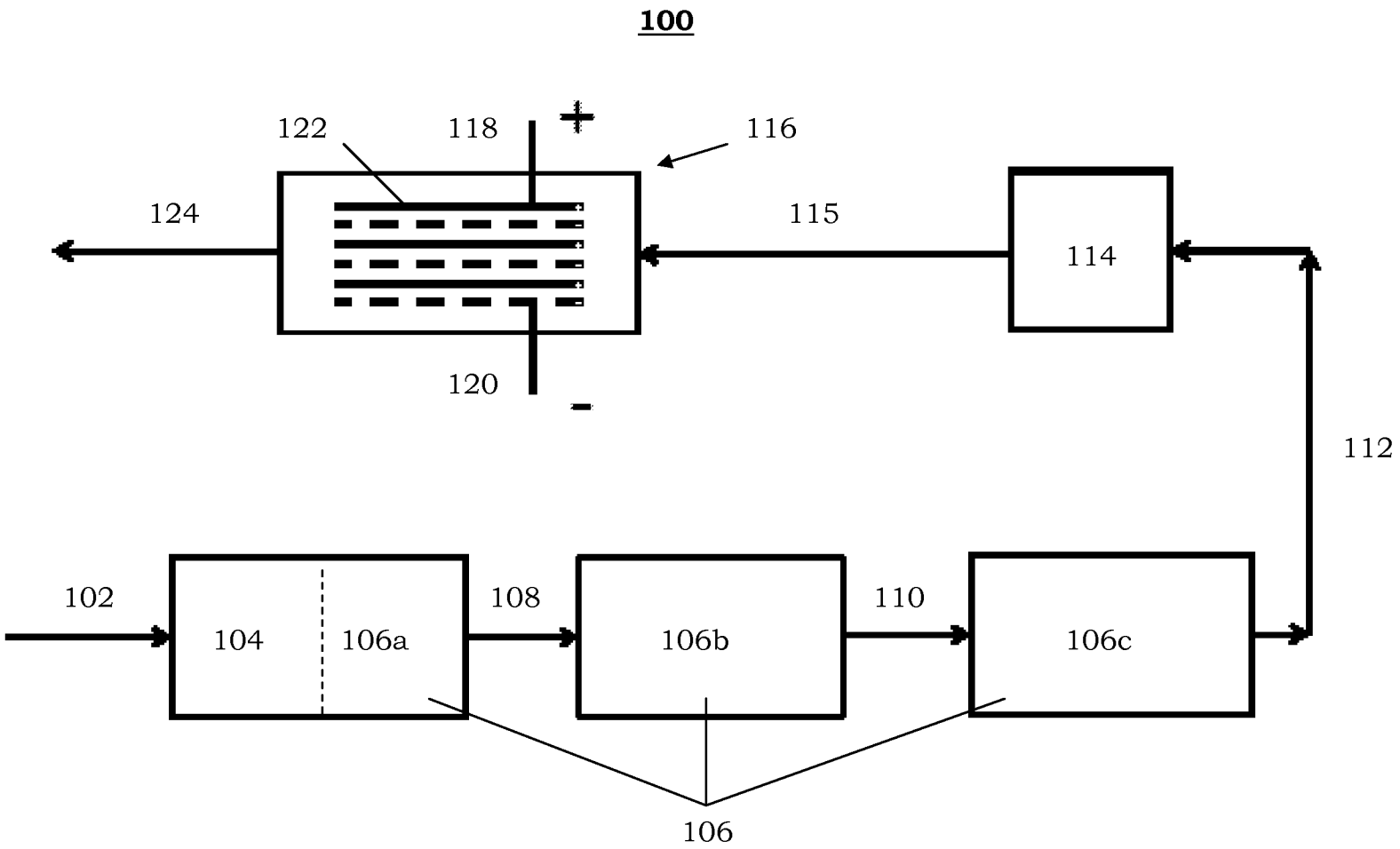
FIG. 3 is a schematic view of another post-accident fission product removal system according to a non-limiting embodiment of the present invention.

FIG. 3 is a schematic view of another post-accident fission product removal system according to a non-limiting embodiment of the present invention. Referring to FIG. 3, the post-accident fission product removal system 100 may be as described in connection with FIGS. 1-2 except that the charged plates 122 corresponding to each of the anode 118 and cathode 120 in the ionization chamber 116 may be in the form of a plurality of strips. The plurality of strips corresponding to the anode 118 may be alternately arranged with the plurality of strips corresponding to the cathode 120. The plurality of strips corresponding to the anode 118 may also extend in a first direction, while the plurality of strips corresponding to the cathode 120 may extend in a second direction. In a non-limiting embodiment, the plurality of strips corresponding to the anode 118 may extend orthogonally relative to the plurality of strips corresponding to the cathode 120.

Figure 4:
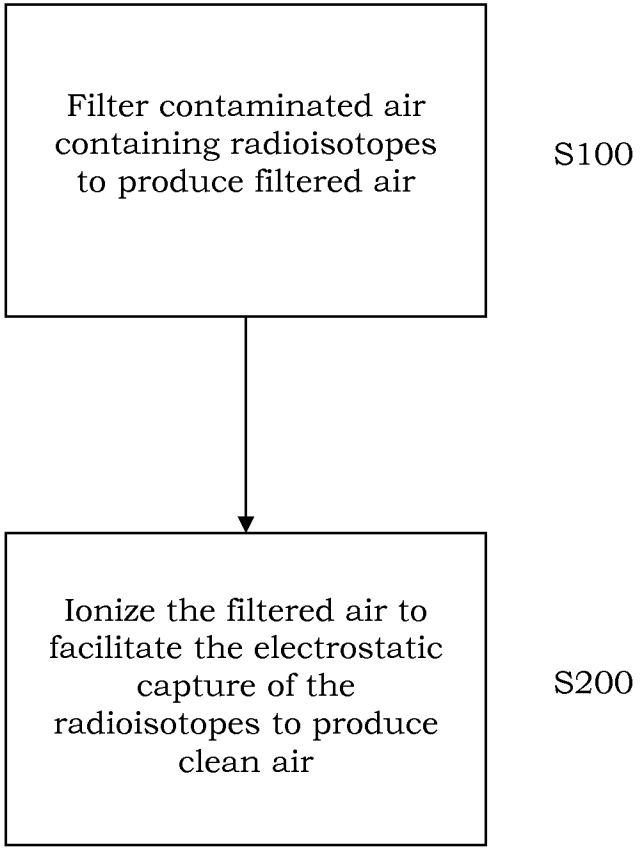
FIG. 4 is a flow chart of a method of removing a post-accident fission product according to a non-limiting embodiment of the present invention.

FIG. 4 is a flow chart of a method of removing a post-accident fission product according to a non-limiting embodiment of the present invention. Referring to FIG. 4, a method of removing a post-accident fission product may include steps S100 and S200. Step S100 may include filtering contaminated air containing radioisotopes to produce filtered air. Step S200 may include ionizing the filtered air to facilitate the electrostatic capture of the radioisotopes to produce clean air.

The filtering in S100 may include centrifuging the contaminated air to separate out larger-sized debris so as to output centrifuged air. The centrifuged air may be carbon filtered with activated carbon to remove gases with an affinity to the activated carbon so as to output carbon-filtered air. The carbon-filtered air may be directed through a high-efficiency particulate air (HEPA) filter to remove smaller particulates missed by the carbon filtering so as to output HEPA-filtered air. As a result, the entry of gross contaminants into the ionization chamber may be prevented, thereby reducing the occurrence of clogging of the ionization chamber.

The ionizing in S200 may include exposing the filtered air to an electric potential of a magnitude that is sufficient to ionize the radioisotopes in the filtered air. The electrostatic capture of the radioisotopes may be performed with charged plates. For example, the electrostatic capture of the radioisotopes may include flowing the filtered air between the charged plates. The electrostatic capture of the radioisotopes may be performed with at least two pairs of oppositely charged plates (for a total of at least four charged plates), although the example embodiments are not limited thereto. For instance, the electrostatic capture of the radioisotopes may be performed with only one pair of oppositely charged plates. When two or more pairs of charged plates are used, the charged plates may be alternately arranged with each other.

The electrostatic capture of the radioisotopes may also include using a battery power source to maintain a charge on the charged plates to prevent escape of the radioisotopes during a removal of the charged plates. The method of removing a post-accident fission product may further include exposing the filtered air to a laser to separate the radioisotopes based on mass prior to ionizing the filtered air.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. A post-accident fission product removal system, comprising:

an air mover connected to a filter assembly, the air mover configured to move contaminated air containing radioisotopes through the filter assembly to produce filtered air; and an ionization chamber connected to the filter assembly, the ionization chamber including an anode and a cathode, the ionization chamber configured to receive the filtered air from the filter assembly and to ionize and electrostatically capture the radioisotopes from the filtered air on a surface of the anode or the cathode to produce clean air.

2. The post-accident fission product removal system according to claim 1, wherein the air mover is a blower or a vacuum.

3. The post-accident fission product removal system according to claim 1, wherein the filter assembly includes:

a centrifugal separator configured to receive the contaminated air and to initially separate out larger-sized debris from the contaminated air so as to output centrifuged air;

a charcoal filter connected to the centrifugal separator, the charcoal filter including activated carbon, the charcoal filter configured to receive the centrifuged air and to remove gases with an affinity to the activated carbon so as to output carbon-filtered air; and a high-efficiency particulate air (HEPA) filter connected to the charcoal filter, the high-efficiency particulate air filter configured to receive the carbon-filtered air and to remove smaller particulates missed by the charcoal filter so as to output HEPA-filtered air.

4. The post-accident fission product removal system according to claim 1, wherein the anode and the cathode are in the form of charged plates in the ionization chamber.

5. The post-accident fission product removal system according to claim 4, wherein the charged plates are arranged in parallel.

6. The post-accident fission product removal system according to claim 4, wherein each of the anode and the cathode are in the form of at least two charged plates.

7. The post-accident fission product removal system according to claim 6, wherein the at least two charged plates of each of the anode and cathode are alternately arranged with each other.

8. The post-accident fission product removal system according to claim 1, wherein the ionization chamber is configured such that the filtered air from the filter assembly is directed to a flow path passing between the anode and the cathode.

9. The post-accident fission product removal system according to claim 1, wherein the ionization chamber is configured to permit sealing and detachment from the post-accident fission product removal system prior to excessive accumulation of the radioisotopes in the ionization chamber.

10. The post-accident fission product removal system according to claim 9, wherein the ionization chamber has a battery power source configured to maintain a charge on the anode and cathode to prevent escape of the radioisotopes during the sealing and detachment of the ionization chamber.

11. The post-accident fission product removal system according to claim 1, further comprising:

a laser separator connected between the filter assembly and the ionization chamber, the laser separator configured to separate the radioisotopes based on mass.

12. A method of removing a post-accident fission product, the method comprising:

filtering contaminated air containing radioisotopes to produce filtered air;

ionizing the filtered air within an ionization chamber to produce ionized radioisotopes; and electrostatically capturing the ionized radioisotopes on a surface of an anode or cathode of the ionization chamber to produce clean air.

13. The method of removing a post-accident fission product according to claim 12, wherein the filtering includes:

centrifuging the contaminated air to separate out larger-sized debris so as to output centrifuged air;

carbon filtering the centrifuged air with activated carbon to remove gases with an affinity to the activated carbon so as to output carbon-filtered air; and directing the carbon-filtered air through a high-efficiency particulate air (HEPA) filter to remove smaller particulates missed by the carbon filtering so as to output HEPA-filtered air.

14. The method of removing a post-accident fission product according to claim 12, wherein the ionizing the filtered air includes exposing the filtered air to an electric potential of a magnitude that is sufficient to ionize the radioisotopes in the filtered air.

15. The method of removing a post-accident fission product according to claim 12, wherein the ionizing the filtered air is performed with charged plates.

16. The method of removing a post-accident fission product according to claim 15, wherein the ionizing the filtered air includes flowing the filtered air between the charged plates.

17. The method of removing a post-accident fission product according to claim 15, wherein the ionizing the filtered air includes using a battery power source to maintain a charge on the charged plates to prevent escape of the radioisotopes during a removal of the ionization chamber.

18. The method of removing a post-accident fission product according to claim 12, wherein the ionizing the filtered air is performed with at least two pairs of oppositely charged plates.

19. The method of removing a post-accident fission product according to claim 12, wherein the ionizing the filtered air is performed with at least two pairs of alternately arranged plates.

20. The method of removing a post-accident fission product according to claim 12, further comprising:

exposing the filtered air to a laser to separate the radioisotopes based on mass prior to ionizing the filtered air.

21. The method of removing a post-accident fission product according to claim 12, further comprising:

sealing and removing the ionization chamber after the electrostatically capturing the ionized radioisotopes.

* * * * *